US005345300A

United States Patent [19]

Uehara et al.

[11] Patent Number: 5,345,300

[45] Date of Patent: Sep. 6, 1994

[54] FIXING UNIT HAVING AN ENDLESS BELT INCLUDING A BASE LAYER AND A COMPOSITE MATERIAL

[75] Inventors: Yasuhiro Uehara; Yasuhiro Kusumoto, both of Kanagawa; Hiroshi Kato; Hiroyasu Kikukawa, both of Okayama, all of Japan

[73] Assignees: Fuji Xerox Co., Ltd.; Japan Gore-Tex Inc., both of Tokyo, Japan

[21] Appl. No.: 28,704

[22] Filed: Feb. 9, 1993

[30] Foreign Application Priority Data

Feb. 10, 1992 [JP] Japan ..... 4-056503

[51] Int. Cl.[5] ..... G03G 15/20

[52] U.S. Cl. ..... 355/285; 219/216

[58] Field of Search ..... 355/282, 284, 285, 290, 355/289; 219/216; 432/60; 118/60

[56] References Cited

U.S. PATENT DOCUMENTS

| | | | |
|---|---|---|---|
| 4,563,073 | 1/1986 | Reynolds | 219/216 X |
| 5,051,784 | 9/1991 | Yamamoto et al. | 355/285 |
| 5,115,278 | 5/1992 | Maruta et al. | 355/285 |
| 5,119,142 | 6/1992 | Swapceinski et al. | 355/285 |
| 5,119,143 | 6/1992 | Shimura | 355/289 |
| 5,123,151 | 6/1992 | Uehara et al. | 219/216 X |
| 5,157,446 | 10/1992 | Kusaka | 355/285 |
| 5,182,606 | 1/1993 | Yamamoto et al. | 355/289 |
| 5,196,675 | 3/1993 | Suzuki et al. | 219/216 |
| 5,204,723 | 4/1993 | Hanada et al. | 355/285 |

FOREIGN PATENT DOCUMENTS

| | | |
|---|---|---|
| 2-9625 | 1/1990 | Japan . |
| 2-39269 | 3/1990 | Japan . |
| 3-21975 | 1/1991 | Japan . |
| 3-38678 | 2/1991 | Japan . |
| 3-125370 | 12/1991 | Japan . |
| 4-18865 | 2/1992 | Japan . |
| 4-115279 | 4/1992 | Japan . |
| 4-58334 | 5/1992 | Japan . |
| 4-67662 | 6/1992 | Japan . |
| 4-195077 | 7/1992 | Japan . |
| 4-199169 | 7/1992 | Japan . |
| 4-89975 | 8/1992 | Japan . |

*Primary Examiner*—A. T. Grimley
*Assistant Examiner*—William J. Royer
*Attorney, Agent, or Firm*—Finnegan, Henderson, Farabow, Garrett & Dunner

[57] ABSTRACT

A fixing unit has a fixing roller and an endless belt. When a recording sheet bearing a toner image not yet fixed passes between the fixing roller and the endless belt, the fixing unit fixes the toner image onto the recording sheet in the nip area. The endless belt is a film-like belt consisting of a base film and a layer on the base film, the layer being made of a composite material containing porous material and elastomer. A fixing unit is thus provided which is free from the problems of image offset and lifetime shortening, and can realize the increase of fixing speed and/or size reduction.

14 Claims, 2 Drawing Sheets

FIXING UNIT HAVING AN ENDLESS BELT INCLUDING A BASE LAYER AND A COMPOSITE MATERIAL

BACKGROUND OF THE INVENTION

1. Field of the Invention

The present invention relates to a fixing unit for use with an image forming apparatus, such as a copying machine, a printer, or a facsimile device. More particularly, the invention relates to a fixing unit of the roll-belt type having a roll and an endless belt, which can meet the demands of high fixing speed and size reduction, and to an endless belt used for the fixing unit.

2. Description of Prior Art

There has been known a heating/pressure roll fixing unit (referred frequently to as a roll-roll fixing unit) as shown in FIG. 3. In the this type of the fixing unit, a pair of rolls having heating function, a fixing roll 1 and a pressure roll 2, are arranged to be in press contact with each other, as shown. A recording sheet 3 carrying thereon a toner image not yet fixed is put into the nip area between the paired rolls 1 and 2. When the recording sheet 3 passes through the nip, the toner image 4 is heated under pressure, so that the toner image is fixed onto the recording sheet 3.

The fixing roll 1 of the fixing unit is composed of a hollowed roll 1*a* made of metal of high thermal conductivity, such as aluminum, an elastic layer 1*b*, an oil-resistant layer 1*c*, and a mold lubricant layer 1*d* , these layers being successively layered on the hollowed roll 1*a* in this order. A heating source 1*e*, such as a halogen lamp, is located within the fixing roll. The pressure roll 2 is composed of a core roll 2*a* made of metal of high thermal conductivity, and a mold lubricant layer 2*d* layered on the core roll. The mold lubricant layer 2*d* is made of polytetrafluoroethylene, for example. A heating source 2*e* as a halogen lamp, for example, is located within the pressure roll. In FIG. 3, reference numeral 5 designates an oil supply unit for supplying oil, for example, silicone oil, which is used for preventing part of a toner image 4 not yet fixed from being transferred onto the fixing roll 1, viz., an offset phenomenon. Reference numeral 6 designates a cleaning unit, and numeral 7 designates a peeling pawl for peeling the recording sheet 3 from the fixing roll 1 and the pressure roll 2. Reference numeral 8 designates a temperature sensor for sensing temperature on the fixing roll 1 and the pressure roll 2.

To increase the processing speed of the fixing unit, it is necessary to increase the width of the nip area, or the nip width, according to a fixing speed, because the fixing of the toner image is carried out with the cooperation of pressure and thermal energy applied thereto when the recording sheet bearing the toner image thereon passes the nip area between the fixing roll 1 and the pressure roll 2.

The possible methods to increase the nip width are to increase the roll-to-roll load between the rolls 1 and 2, to increase the thickness of the elastic layer 1*b* of the fixing roll 1, and to increase the diameters of the rolls 1 and 2 . The roll-to-roll load increasing method and the layer thickness increasing method are disadvantageous in the following points. Flexure of the rolls renders the nip width of the nip area nonuniform in the axial direction of the rolls. Further, the fixing operation is irregular or the recording sheet is wrinkled. For those reasons, there is a limit in increasing the roll-to-roll load and the thickness of the elastic layer 1*b*. Eventually, those methods fail to attain a desired increase of the fixing speed. The roll-diameter increasing method results in increase of the apparatus size, and consequently an elongation of warm-up time taken for the temperature of the rolls 1 and 2 to raise from room temperature to a fusing temperature.

Another fixing method that can gain a great nip width of the nip area is a called roll-belt method which uses a fixing roll with a heating source and an endless belt turning in pressure contact with the fixing roll, the belt being made of polytetrafluoroethylene or silicone rubber (used in place of the pressure roll).

In the roll-belt method, when the endless belt coated with polytetrafluoroethylene is used, the toner, which has been offset to the fixing roll, hardly smudges the recording sheet because it is hardly transferred to the endless belt. However, the recording sheet tends to slip thereon since the surface of the belt has a small friction coefficient. When it slips, the rotating speed of the fixing roll becomes different from that of the endless belt. The toner image, when fixed, becomes offset, viz., an image offset occurs. To prevent this, the fixing roll and the endless belt must be rotated at the same speed. The drivers capable of rotating the roll and belt at the same speed are large and complicated. In the case of the endless belt made of silicone rubber, the surface of the belt has a large friction coefficient. Accordingly, it is free from the image offset problem. However, the silicone rubber belt has another problem that the belt is swelled by an offset preventing liquid, or the silicone oil, in which the belt is immersed. The swelled rubber becomes weak and changes in quality. Further, when the support rolls and the fixing roll are reduced in diameter for the purpose of size reduction, the endless belt is more repeatedly bent or extended with a large curvature. This leads to crack of the belt surface and hence shortening of the lifetime of the belt.

SUMMARY OF THE INVENTION

The inventors of the present patent application studied the fixing unit which is free from the problems of image offset and shortening of the lifetime, allows use of a simple driver, and can realize the increase of fixing speed and/or size reduction, and reached the technical idea of the present invention.

Accordingly, an object of the present invention is to provide a fixing unit which is free from the problems of image offset and shortening of the lifetime, and can realize the increase of fixing speed and/or size reduction.

Another object of the present invention is to provide an endless belt suitable for the fixing unit which is free from the problems of image offset and shortening of the lifetime, and can realize the increase of fixing speed and/or size reduction.

To achieve the first object, there is provided a fixing unit having a fixing roll and an endless belt in press contact with the fixing roll in a nip area formed, when a recording sheet bearing thereon a toner image not yet fixed passes between the fixing roll and the endless belt, the fixing unit fixes the toner image onto the recording sheet in the nip area, wherein the endless belt is a film-like belt consisting of a base film and a layer layered on the base film, the layer being made of a composite material containing porous material and elastomer.

According to the second object, there is provided an endless belt for a fixing unit in which the endless belt is in press contact with a fixing roll in a nip area formed, and when a recording sheet bearing thereon a toner image not yet fixed passes through the nip area of the fixing roll and the endless belt, the fixing unit fixes the toner image onto the recording sheet in the nip area, wherein the endless belt is a film-like belt consisting of a base film and a layer layered on the base film, the layer being made of a composite material containing porous material and elastomer.

As described above, the endless belt of the invention is a laminated film-like belt consisting of a base film and a layer layered on the base film, the covering layer made of a composite material containing porous material and elastomer. With provision of the covering layer, the endless belt is good in mold lubrication and high friction coefficient. Further, the large nip width of the nip area enables the fixing speed to be increased. Additionally, the reduced diameter of the support rolls provides the size reduction of the fixing unit. Either of the fixing roll and the endless belt may be used for driving the fixing unit. That is, when the fixing roll is driven, the endless belt follows the fixing roll, and the converse is also true. This feature may simplify the construction of the fixing unit driver.

DETAILED DESCRIPTION OF PREFERRED EMBODIMENTS

Figure 1:
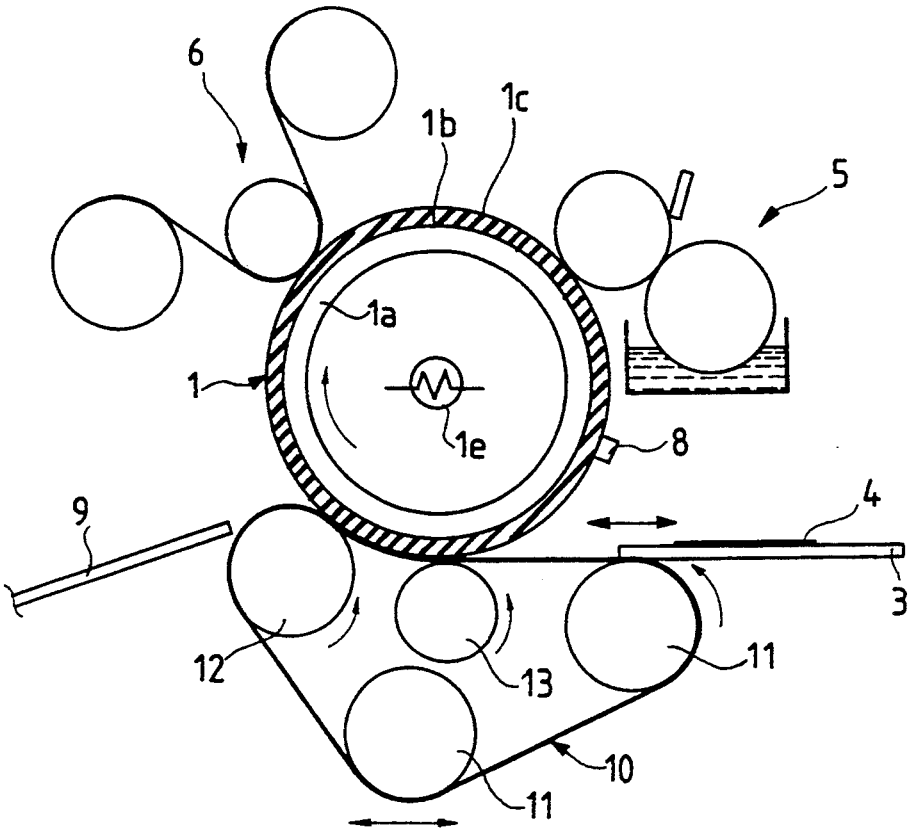
FIG. 1 is an explanatory diagram showing a fixing unit according to an embodiment of the present invention.

The base film of the endless belt may be any film if it is so flexible and strong as to allow it to wind tight the support rolls and the pressure rolls, which are provided for supporting the endless belt, and any of a polymer film, a metal film, a ceramic film, and a glass fiber film or the composite film of two or more of them.

The polymer film may be a sheet- or cloth-like film made of any of polyester, for example, polyethyleneterephthalate; polycarbonate; polyimide; fluoropolymer such as polyvinyl fluoride and polytetrafluoroethylene; polyamide, for example, nylon; polyacryl and polystyrene; polyethylene and polypropylene; cellulose modified material, for example, cellulose acetate; polysulfone; polyxylene; polyacetal; and the like. A general polymer sheet may be a polymer composite sheet by laminating heat-resistant resin layers made of fluoropolymer, silicone, crosslinked polymer or the like. The polymer film may be laminated on a heat-resistant layer made of metal or ceramics. A granule-, needle-, or fiber-like thermal-conduction improving agent of carbon black, graphite, alumina, silicone, carbide, boron nitride, or the like may be added to the polymer film. If required, any of or the combination of conduction improving, charge protection, magnetizing, mold lubricant, and reinforcing additives may be added or applied to the polymer film or only the surface of the film. The polymer film may be substituted by a paper such as condenser paper or glassine paper, ceramic film, cloth-like film woven of glass fibers or a metal film, such as a stainless film or a nickel film.

The layer laminated on the base film (the layer will be referred to as a covering layer) is made of a composite material containing porous material and elastomer. Preferably, it is lubricous for the toner.

The porous layer is made of resin, preferably heat-resistant resin, ceramics, metal or the combination of them. In the light of workability, it is preferably made of a continuous porous material having continuous voids. More preferable porous material is fibrillated resin formed in a manner that resin, preferably heat-resistant resin, such as polytetrafluoroethylene (PTFE) or polypropylene (PP), is rolled, extruded, mulled or extended, viz., subjected to shearing force, into porous resin with continuous voids.

The elastomer to be mixed with the porous material is a key material to give the covering layer the properties of high mold lubrication and high friction coefficient. The elastomer may be of the room temperature cure type (RTV) or the low temperature cure type (LTV). RTV silicone rubber, LTV silicone rubber, fluororubber, or fluorosilicone rubber may be used for the elastomer. If mold lubricant oil, e.g., silicone oil, is added to the elastomer, the mold lubricant property is further improved. To improve the thermal conductive property, it may contain inorganic powder of carbon black, graphite, boron nitride, alumina, silica or the like.

In the present invention, the endless belt is a film like body having the thickness of 300 μm or less, preferably 100 μm or less. The thickness of the belt may be reduced as desired so far as it can be fit for use. However, the belt, when extremely thinned, cannot have the required strength. Further, it is difficult to give desired properties to the covering layer, which assumes a key role when the belt is given the properties of high mold lubrication and high friction coefficient. Accordingly, the belt thickness of at least 15 μm must be secured. On the other hand, the belt of 300 μm or more thickness is disadvantageous in that when wound tightly around the support rolls and the fixing roll, it is difficult to increase a curvature of the belt. Accordingly, the thick belt hinders the size reduction of the endless belt of a good endurance.

The thickness of the base film of the endless belt is within the range of 15 to 200 μm, preferably 50 to 75 μm. The thickness of the covering layer, or the lamination to be laminated on the base film, is within the range from 5 to 100 μm, preferably 5 to 20 μm.

A friction coefficient of the surface of the endless belt for the recording sheet, for example, paper, is within the range of 0.15 to 1.0, preferably 0.2 to 0.8. When the friction coefficient of the belt surface is smaller than 0.15, the fixing roll may slip on the endless belt. When the friction coefficient is 1.0 or more, an adhesion value is excessive, so that the paper is hardly peeled off the belt. Further, unmelted materials, such as paper powder and dust, are apt to stick to the belt surface. The excessive adhesion value also makes it difficult to clean the belt.

The heat resistance of the endless belt is at least 100° C., preferably 150° C. or higher. The high heat resistance allows the image fixation not only under pressure but also under pressure and heating.

The methods of manufacturing an endless belt constructed as described above will be described. In the endless belt, the porous material of the covering layer was fibrillated resin.

In the first method, elastomer and resin were mixed at a predetermined mixing ratio, and molded into a sheet-like body by a normal molding method, for example, a method in which it is mulled and rolled, or an extrusion molding. The base film was subjected to a suitable adhesion improving process, such as a primer process. The above-formed sheet-like body was bonded on the surface of the base film. The laminate was heated to harden the elastomer. Finally, the surface of the layer laminated on the base film was polished.

In the second method, resin was fibrillated to form porous material. The porous material was impregnated with elastomer. The resultant sheet-like body was bonded on the surface of a base film after it was processed for improving adhesion. The laminate was heated for hardening the elastomer contained. In the method, the formed porous material may be laminated over the base film after one of the surfaces of the formed porous sheet-like body is coated with adhesive or after the porous material is impregnated with elastomer and heated for hardening the elastomer, and one of the surfaces of it is entirely coated with adhesive. Alternatively, the porous material is bonded over the surface of the base film by adhesive, the porous material layered on the base film is impregnated with elastomer, and the laminate is heated for hardening the elastomer.

The endless belt thus manufactured may be used for any type of fixing unit if it is of the roll-belt type which includes a fixing roll and a fixing endless belt turning in press contact with the fixing roll. For the purposes of increasing the fixing speed and reducing the size of the unit, it is preferable that the endless belt is wound tight around a plural number of support rolls, and it is pressed against the fixing roll over the nip area of a broad nip width by the pressure roll.

The present invention will be described in detail using some examples of the invention and comparison examples.

Example 1

FIG. 1 is a cross sectional view showing a fixing unit of the roll-belt type, which was used in the examples to be given. In the fixing unit, a fixing roll 1 is composed of a hollowed roll 1*a*, an elastic layer 1*b* layered on the hollowed roll 1*a*, and an oil-resistant layer 1*c* layered on the surface of the elastic layer 1*b* . A heating source l*e* as a halogen lamp is disposed within the roll. The hollowed roll 1*a* , made of aluminum, was 46 mm in outer diameter, 40 mm inner diameter, and 300 mm long. The elastic layer 1*b* of 2 mm thick was made of high temperature curing (HTV) silicone rubber (rubber hardness 45 degree). The oil-resistant layer 1*c* was formed fluororubber which was dip-coated with RTV silicone rubber, and it was 50 μm thick. A film-like endless belt 10 was 300 mm wide×288 mm long (circumferentially)×75 μm thick. The endless belt 10 was wound tight around two support rolls 11 of 200 mm diameter and a pressure roll 12 of 22mm diameter. The pressure roll 12 presses the endless belt against the surface of the fixing roll 1, and cooperates with a sponge roll 13 to form a nip area of a wide nip width.

In this example, the endless belt 10 is driven by the fixing roll 1. In FIG. 1, reference numeral 5 designates an oil supply unit; numeral 6, a cleaning unit; numeral 8, a temperature sensor; and numeral 9, a chute for guiding the sheet 3 for its discharging.

Figure 2:
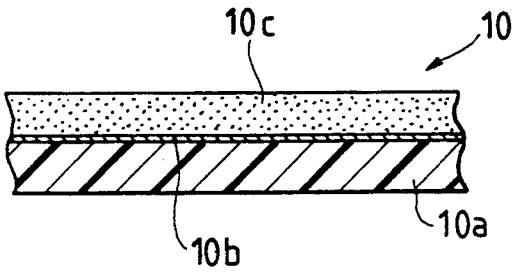
FIG. 2 is a partial cross sectional view showing an endless belt used in the fixing unit of FIG. 1.
Figure 3:
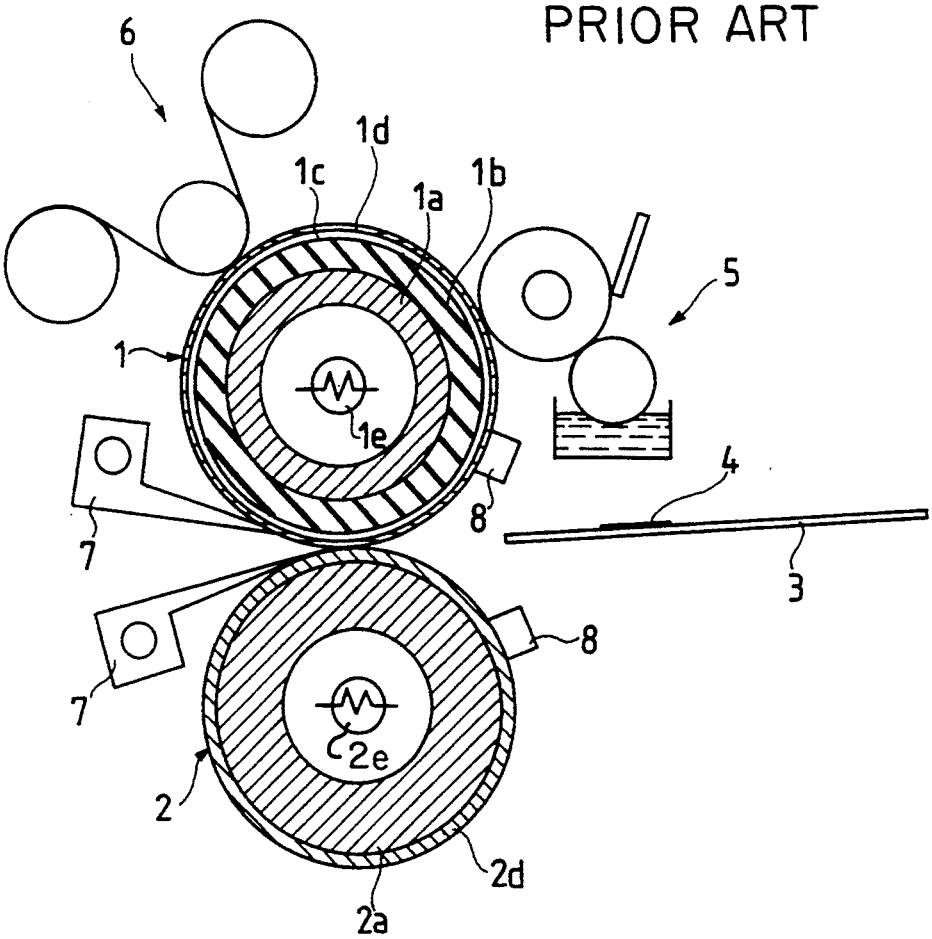
FIG. 3 PRIOR ART
FIG. 3 is an explanatory diagram showing a conventional roll-roll fixing unit.

The endless belt 10 was constructed such that, as shown in FIG. 2, the surface of a base film 10*a* made of polyimide, 75 μm thick, was coated with adhesive of polyurethane adhesive, forming an adhesive layer 10*b* of 5 μm thick, and a layer or lamination 10*c* of 20 μm thick was layered or laminated on the adhesive layer 10*b* with the overlap width of 5 mm. The layer 10*c* (referred to as a covering layer) was formed in a manner that extended porous PTFE of 90% in porosity (trade name: GORE-TEX, manufactured by Japan Gore-Tex Inc.) was impregnated with RTV silicone rubber, and the lamination was heated at 120° C. for one hour.

The endless belt 10 was tightened around the support rolls 11 and the pressure roll 12 at the tensile force of 10 kg. The pressure roll 12 was urged, under the pressure of 20 kg, toward the center of the fixing roll 1 by means of a compressed coil spring, not shown. A contact angle of the endless belt 10 to the fixing roll 1 was 45°. The nip width of the nip area was 19.6 mm.

The thus constructed fixing unit of the roll-belt type was operated for a continuous fixing test under the following conditions. The rotating speed of the fixing roll 1 and the endless belt was 250 mm/min. The surface temperature of the fixing roll was 150°. The copy speed was 10 copies of A4 size per minute. The recording sheet was P paper (manufactured by FUJI XEROX Co. Ltd.). The toner was composed of polyester resin of 95 wt %, pigment of 4 wt % and charge control agent of 1 wt. %. After the toner images of 50,000 copies were fixed, any swell of the endless belt 10, caused by the silicone oil, was not observed. No crack was observed on the surface of the belt. The mold lubrication, paper peel-off, stability, and coloring were satisfactory. The step 5 μm, which was formed at the winding end portion of the belt when the covering layer 10*c* was layered, did not affect any influence on the fixed image. Further, the abnormal rotation of the fixing roll 1 owing to the slip occurring in the nip area, and the image offset caused by the abnormal rotation were not observed.

EXAMPLE 2

30 parts by weight of PTFE resin (trade name, TEFLON, manufactured by Dupon corporation) and 100 parts by weight of RTV silicone rubber were mixed and mulled, and then rolled, thereby compounding the fibrillated PTFE and the RTV silicone rubber into a composite sheet of 100 μm thick.

As in Example 1, the surface of the base film made of polyimide is coated with the primer for silicone rubber. The composite sheet was wound around the base film by three turns, and was fixed at the end. The resultant laminate was heated at 120° C. for three hours for hardening the silicone. The surface of the laminate was polished. The endless belt thus manufactured, was 300mm wide×288 mm long (circumferentially)×100 μm thick (the base film was 75 μm thick and the covering layer was 25 μm thick).

A continuous fixing test was conducted using the endless belt as in the manner of Example 1. After fixing of the toner images of 20,000 copies, no silicone-oil caused swell of the belt and no crack on the belt surface were observed. The performances of the fixing, mold lubrication, paper peel-off, stability, coloring and the like were satisfactory. No image offset was observed.

EXAMPLE 3

The surface of a base film, made of polyimide as used in Example 1, was coated with the primer for silicone rubber. A sheet of extended porous PTFE material of 90 % in porosity (trade name: GORE-TEX, manufactured by Japan Gore-Tex Inc.), 10 μm thick, was wound around the base film by three turns, and was fixed at the end. The resultant laminate was immersed in a liquid of RTV fluorosilicone rubber to impregnate the porous PTFE material with the silicone rubber liquid. Then, the resultant laminate was heated at 120° C. for three hours for hardening the silicone. The thus manufactured endless belt, was 300 mm wide×288 mm long (circumferentially)×110 μm thick (the base film was 75 μm thick and the covering layer was 35 μm thick).

A continuous fixing test was conducted using the endless belt as in the manner of Example 1. After fixing of 30,000 copies, no silicone-oil caused swell of the belt and no crack on the belt surface were observed. The performances of the fixing, mold lubrication, paper peel-off, stability, coloring and the like were satisfactory. No image offset was observed.

EXAMPLE 4

One side of expanded porous polypropylene (DURAGUARD, trade name, manufactured by POLYPLASTIC corporation) of 20 μm thick and 40 % in porosity was coated with polyurethane adhesive, and the adhesive was dried, thereby to form an adhesive layer of 5 μm on the porous polyproplylene sheet. The porous sheet with the adhesive layer was wound by one turn around a base film of polyimide as in. Example 1 with the overlap width of 5 mm. Then, it is immersed in RTV silicone rubber liquid, so that the porous polypropylene is impregnated with silicone rubber liquid. The laminated body was heated at 100° C. for two hours to harden. The thus manufactured endless belt, was 300 mm wide×288 mm long (circumferentially)×105 μm thick (the base film was 75 μm thick and the covering layer was 30 μm thick).

A continuous fixing test was conducted using the endless belt as in the manner of Example 1. No silicone-oil caused swell of the belt and no crack on the belt surface were observed. The performances of the fixing, mold lubrication, paper peel-off, stability, coloring and the like were satisfactory. No image offset was observed.

Comparison Example 1

A mold lubrication layer of polytetrafluoroethylene, 25 μm thick, was formed over the surface of a base film of the same type as used in the above examples. The thus formed endless belt was set in the fixing unit of Example 1. Using the fixing unit, a continuous fixing test was conducted as in Example 1. The test results as follows. No mechanical damage of the endless belt was observed. When an image was fixed to both sides, obverse and reverse sides, of the recording paper, the image first fixed to the obverse side of the paper suffered from brilliance irregular. Where an amount of image toner was large, the paper stuck to the endless belt. When a sufficient amount of silicone oil was supplied to the fixing roller, the rotation of the fixing roller was irregular and the image offset was observed.

Comparison Example 2

A mold lubrication layer of RTV silicone rubber, 50 μm thick, was formed over the surface of a base film of the same type as used in the above examples. The thus formed endless belt was set in the fixing unit of Example 1. Using the fixing unit, a continuous fixing text was conducted as in Example 1. After the toner image of approximately 3,000 copies were fixed, the mold lubrication layer cracked and a part of the layer peeled off the base film.

As seen from the foregoing description, an endless belt of the invention, which is used for a roll-belt fixing unit, is a film-like body consisting of a base film and a layer, layered on the base film, made of composite material containing porous material and elastomer. The excellent mold lubrication and high friction coefficient of the covering layer solves the image offset problem and provides excellent fixing performance. A wide nip width can readily be secured, realizing high fixing operation. Since the endless belt is a thin film, the diameter of the support rolls, which support the endless belt, can be reduced. This leads to size reduction of the fixing unit. During the fixing operation, excessive stress will not be exerted on the endless belt, so that its endurance is improved. Thus, the invention can realize both the increase of the fixing speed and the size reduction of the fixing unit. As a consequence, the present invention has successfully provided a fixing unit, which is useful for image recording apparatuses, such as copying machines, printers, and facsimile devices.

What is claimed is:

1. A fixing unit for fixing a toner image onto a recording sheet, the fixing unit comprising:

a fixing roll and an endless belt in press contact with the fixing roll in a nip area so that when the recording sheet bearing the toner image not yet fixed passes between the fixing roll and the endless belt, said fixing unit fixes the toner image onto the recording sheet in the nip area;

wherein said endless belt is a film-like belt consisting essentially of a base film and a covering layer layered on said base film, said covering layer being made of a composite material containing porous material and elastomer.

2. The fixing unit according to claim 1, wherein said endless belt has a thickness of 300 μm or less.

3. The fixing unit according to claim 2, wherein said base film has a thickness within the range of 15 to 200 μm, and said covering layer layered on said base film has a thickness within the range of 5 to 100 μm.

4. The fixing unit according to claim 1, wherein said endless belt is wound tightly around a plurality of rolls, and is brought into press contact with said fixing roll in the nip area by means of said fixing roll.

5. The fixing unit according to claim 1, wherein the endless belt has a friction coefficient in a range of 0.15 to 1.0.

6. The fixing unit according to claim 5, wherein the friction coefficient is in a range of 0.2 to 0.8.

7. An endless belt for a fixing unit for fixing a toner image onto a recording sheet, comprising:

a film-like belt consisting essentially of a base film and a layer layered on said base film, said layer being made of a composite material containing porous material and elastomer;

wherein said endless belt is in press contact with a fixing roll in a nip area so that when the recording sheet bearing the toner image not yet fixed passes through the nip area of said fixing roll and said endless belt, said fixing unit fixes the toner image onto the recording sheet in the nip area.

8. The endless belt according to claim 7, wherein said base film is any of a polymer film, a metal film, a ceramic film and a glass fiber film, or a composite film consisting of at least two of a polymer film, a metal film, a ceramic film and a glass fiber film.

9. The endless belt according to claim 7, wherein said layer layered on said base film is made of a composite material containing elastomer and fibrillated resin formed by fibrillating resin under shearing force, and serves as a mold lubricant layer lubricous for toner.

10. The endless belt according to claim 7, wherein a surface of the endless belt exposed to the recording sheet has a friction coefficient in a range of 0.15 to 1.0.

11. The endless belt according to claim 10, wherein the friction coefficient is in a range of 0.2 to 0.8.

12. An endless belt for a fixing unit for fixing a toner image onto a recording sheet, comprising:

a film-like belt consisting essentially of a base film and a layer layered on the base film, the layer being made of a composite material containing porous material and elastomer, the endless belt having a heat-resistance of at least 100° C.;

wherein the endless belt is in press contact with a fixing roll in a nip area so that when the recording sheet bearing the toner image not yet fixed passes through the nip area, the fixing unit fixes the toner image onto the recording sheet in the nip area.

13. The endless belt according to claim 12, wherein a surface of the endless belt exposed to the recording sheet has a friction coefficient in a range of 0.15 to 1.0.

14. The endless belt according to claim 13, wherein the friction coefficient is in a range of 0.2 to 0.8.

* * * * *